US005106521A

United States Patent [19]

Kurachi et al.

[11] Patent Number: 5,106,521

[45] Date of Patent: Apr. 21, 1992

[54] ELECTRORHEOLOGICAL FLUIDS COMPRISING CARBONACEOUS PARTICULATES DISPERSED IN ELECTRICAL INSULATING OILY MEDIUM CONTAINING A COMPOUND HAVING SPECIFIC FUNCTIONAL GROUPS

[75] Inventors: Yasuo Kurachi, Tokyo; Osaki Toshiyuki, Higashimurayama; Mitsuya Tanaka, Kodaira; Yuichi Ishino, Fuchu; Tasuku Saito, Tokorozawa, all of Japan

[73] Assignee: Bridgestone Corporation, Tokyo, Japan

[21] Appl. No.: 594,543

[22] Filed: Oct. 9, 1990

[30] Foreign Application Priority Data

| | | | |
|---|---|---|---|
| Oct. 9, 1989 | [JP] | Japan | 1-262030 |
| Oct. 25, 1989 | [JP] | Japan | 1-275927 |
| Nov. 15, 1989 | [JP] | Japan | 1-294838 |

[51] Int. Cl.[5] ..... C10M 169.04; C10M 125/02; C09K 3/00

[52] U.S. Cl. ..... 252/73; 252/77; 252/78.1; 252/78.3; 252/78.5; 252/79; 252/572

[58] Field of Search ..... 252/74, 75, 76, 574, 252/575, 572, 73, 77, 78.1, 78.3, 78.5, 79

[56] References Cited

U.S. PATENT DOCUMENTS

| | | | |
|---|---|---|---|
| 2,876,247 | 3/1959 | Rätz et al. | 252/574 |
| 3,047,507 | 7/1962 | Winslow | 252/75 |
| 3,280,222 | 10/1966 | Kober et al. | 252/77 |
| 3,280,223 | 10/1966 | Kober et al. | 252/77 |
| 3,291,865 | 12/1966 | Kober et al. | 252/77 |
| 4,317,159 | 2/1982 | Dequasie | 252/575 |
| 4,449,163 | 5/1984 | Dequasie | 252/573 |
| 4,687,589 | 8/1987 | Block et al. | 252/572 |

FOREIGN PATENT DOCUMENTS

| | | |
|---|---|---|
| 0136772 | 4/1985 | European Pat. Off. . |
| 361106 | 4/1990 | European Pat. Off. . |
| 64-6285 | 1/1989 | Japan . |
| 1432902 | 4/1976 | United Kingdom . |
| 1545281 | 5/1979 | United Kingdom . |
| 1545282 | 5/1979 | United Kingdom . |
| 1545283 | 5/1979 | United Kingdom . |

OTHER PUBLICATIONS

Matsepuro, "Structure Formation in an Electric Field and the composition of Electrorheological Suspensions", translated from Electrorecl. Isslded: Pril., Minsk, 1981.

*Carbon*, International Cooperation on Characterization and Nomenclature of Carbon and Graphite, 1975, vol. 13, p. 251.

*Carbon*, International Committee for Characterization and Terminology of Carbon "First Publication of Further 24 Tentative Definitions", 1983, vol. 21, pp. 517–519.

*Primary Examiner*—A. Lionel Clingman
*Assistant Examiner*—Christine A. Skane
*Attorney, Agent, or Firm*—Cushman, Darby & Cushman

[57] ABSTRACT

Electrorheological fluids display swift and reversible increase in apparent viscosity under application of an electrical potential difference to the fluid, and are composed generally of electrical insulating oily medium and dielectric fine-particles dispersed therein.

At the initial stage of development, electrorheological fluids are prepared by dispersing water-carrying hydrophilic particulates in an electrical insulating oily medium. However, there are such defects as a restriction on usable temperatures so as to avoid evaporation or freezing of the water, an extreme increase in the electric current flow as the temperature raises, inferior stability caused by transfer of water etc.

It is an object of the persent invention is to provide nonaqueous type electrorheological fluids having improved electrorheological property.

The electrorheological fluid of the present invention is a nonaqueous type electrorheological fluid which comprises organic or inorganic particulates containing not more than 1 wt. % of water and dispersed in an oily medium superior in electrical insulation, wherein the improvement is that said fluid comprises from 0.001 wt. % to 10 wt. % of a compound having a functional group containing at least one atom selected from the group consisted of oxygen atom, nitrogen atom, sulfur atom and phosphorous atom.

2 Claims, 1 Drawing Sheet

ELECTRORHEOLOGICAL FLUIDS COMPRISING CARBONACEOUS PARTICULATES DISPERSED IN ELECTRICAL INSULATING OILY MEDIUM CONTAINING A COMPOUND HAVING SPECIFIC FUNCTIONAL GROUPS

FIELD OF THE INVENTION

The present invention relates to electrorheological fluids, especially to nonaqueous type electrorheological fluids substantially containing no water, which are capable of changing remarkably and reversibly their viscoelastic property by means of regulating electrical potential difference applied thereto. The fluid is useful for electrical regulation of such mechanical apparatus as engine-mounts, shock absorbers, valves, actuators, clutches, etc.

DESCRIPTION OF THE PRIOR ART

The phenomenon of changing apparent viscosity of a fluid by application of an electrical potential difference is known as the Winslow's effect for many years. At the initial stage of development, the fluid was composed of starch or the like dispersed in a mineral oil or a lubricating oil. Though the fluid was able to show the importance of the electrorheological effect, but repeatability of the electrorheological effect was unsatisfactory.

For the purpose of obtaining fluids superior in the electrorheological property and repeatability, a number of proposal mainly concerned with particulates used for the dispersoid have been made. For example, highly hygroscopic resin particulates having acid groups like polyacrylic acid (Japanese Patent Provisional Publication Tokkai Sho 53-93186 [1978]), ion exchange resins (Japanese Patent Publication Tokko Sho 60-31211 [1985]), aluminosilicates (Japanese Patent Provisional Publication Tokkai Sho 62-95397 [1987]), etc. are known.

All of these electrorheological fluids are prepared by dispersing water-carrying hydrophilic particulates in an electrical insulating oily medium, and polarization of the particulates owing to the performance of water occurs when a high electrical potential difference is applied from the outside. The increase in viscosity is said to be caused by formation of bridging between particulates in the direction of the electrical field under the influence of the polarization.

In electrorheological fluids employing the water-carrying particulates, however, there are such defects as a restriction on usable temperatures so as to avoid evaporation or freezing of the water, an extreme increase in the electric current flow as the temperature raises, inferior stability caused by transfer of water and dissolution of metallic electrodes under application of high electrical potential difference, which place obstacles in the practical application of electrorheological fluids.

Nonaqueous type electrorheological fluids substantially containing no water employing highly dielectric materials or semiconductive particulates as the dispersoid have been proposed recently. For example, fluids employing organic semi-conductive particulates such as polyacenequinone (Japanese Patent Provisional Publication Tokkai Sho 61-216202 [1986]), and dielectric particulates prepared by forming a conductive thin film on the surface of organic solid particulate and then further forming thereon an electrical insulating thin film (Japanese Patent Provisional Publication Tokkai Sho 63-97694 [1988]) are proposed.

Studies are proceeding on nonaqueous type electrorheological fluids, since they are expected to have possibilities of overcoming various conventional defects in water-carrying electrorheological fluids derived from the existence of water.

The present inventors have found as the result of their research based on this viewpoint that optically anisotropic carbon particulates can exhibit superior electrorheological effect in the nonaqueous type electrorheological fluid (Japanese Patent Application Sho 63-212615 [1988]).

Even in these nonaqueous type electrorheological fluids, however, it has become clear that there is a new problem not appeared in the conventional water carrying electrorheological fluids, and that their applications are confined. Further, there are such problems to be solved for the practical application of the electrorheological fluids as the improvement of the electrorheological effect, lessening of the electric current, prevention of the sedimentation of the particulates etc.

The above mentioned new problem is that when a nonaqueous type electrorheological fluid is employed for a mechanical apparatus holding rubber or resins as the constituting elements, the viscosity of the fluid under no application of electrical potential difference (initial viscosity) increases gradually as the time proceeds and operating characteristics of the apparatus is worsened greatly. The increase of the initial viscosity is a phenomenon never seen in conventional water-carrying electrorheological fluid systems (refer to Reference Example mentioned hereinafter) but has been recognized as a problem common to nonaqueous type electrorheological fluids.

The present inventors made studies on the increase of the initial viscosity of nonaqueous type electrorheological fluids employed in mechanical apparatus holding rubber, resins, composites thereof, etc. as the constituting elements, on which the increase of initial viscosity has never been experienced in water carrying electrorheological fluids. As the result, they found out that components incorporated in rubber, resins, etc. were gradually extracted in the electrorheological fluid, and the extracted components caused increase in the initial viscosity to bring about change of the initial characteristics, and the countermeasures were contemplated.

Insulating oily medium used in electrorheological fluids are usually low polar compounds in order to satisfy the required electrical characteristics. When foreign components are incorporated as extracts in the insulting oily medium, its viscosity characteristics changes. The change of viscosity characteristics depends on the extracted component, and an increase in initial viscosity occurs when the extracted component has a higher viscosity than that of the insulating oily medium. Further, when the extracted component is solid at room temperature and has a solubility parameter (SP value) slightly different from that of the insulating oily medium, there sometimes occurs turning of the insulating oily medium into a state of butter by a trace amount of the extract.

Usually, various kinds of substances are incorporated in rubber, resins or their composite materials, for the purpose of improving their properties and preventing deterioration of them at practical applications. In addition to these incorporated components, unreacted low molecular weight materials contained in the rubber, resins or composite materials have possibilities of being extracted by the insulating oily medium. Accordingly, when rubber, resins or their composite materials are used as constituting elements of mechanical apparatus and when an electrorheological fluid is employed for the apparatus, insulating oily medium of the electrorheological fluid may extract components contained in the rubber, resin or composite materials to result in a change in the initial viscosity of the electrorheological fluid.

Generally in water-carrying electrorheological fluids, particulates of materials with high content of oxygen atom having strong affinity for water like aluminum silicates (Japanese Patent Provisional Publication Tokkai Sho 62-95397 [1987]) are utilized, due to the necessity of water adsorption. The electrorheological effect is induced by highly polar water contained in 1–25 wt.% at inside or outside of the particulates, and the behavior of water is not only inducing the electrorheological effect but also has been found to remove origins for causing the initial viscosity increase.

For instance, in case of an electrorheological fluid employed in a mechanical apparatus holding a rubber as the constituting element, such substances as wax being solid at room temperature and mostly polymeric compound contained in the rubber are extracted by a low polar insulating oil utilized for the electrorheological fluid. And, when the content of water is less than 1 wt.%, the extracted low polar wax turns to a swelled state in the low polar insulating oil because the low polar insulating oil is a good solvent of the wax. Further, as the wax is solid at room temperature, it partly crystallizes forming quazi-bridging points to results in an increase in the initial viscosity.

However, if molecules of a highly polar material like water exists in the situation, the polymeric wax chain is electron charged and the expanded molecules shrink as if in an poor solvent without formation of the quazi-bridging points and its precipitation occurs. Accordingly, the increase of the initial viscosity is small and negligible.

On the other hand, in the case of nonaqueous type electrorheological fluids containing no water, when wax contained in rubber is extracted in the fluid even in an amount of less than 0.5 wt.%, the fluid turns to a state of butter and the initial viscosity increases highly to cause problems for the practical application.

SUMMARY OF THE INVENTION

It is an object of the present invention to provide nonaqueous type electrorheological fluids having improved electrorheological property.

Another object of the present invention is the improvement of the stability of the nonaqueous type electrorheological fluids.

Further object of the present invention is to provide nonaqueous type electrorheological fluids solving the problem characteristic to nonaqueous type electrorheological fluids, showing little change in its initial viscosity at practical applications in mechanical apparatus in which the fluid is employed under contact with rubber, resins, etc.

The electrorheological fluid of the present invention is a nonaqueous type electrorheological fluid which comprises organic or inorganic particulates containing not more than 1 wt.% of water and dispersed in an oily medium superior in electrical insulation, wherein the improvement is that said fluid comprises from 0.001 wt.% to 10 wt.% of a compound having a functional group containing at least one atom selected from the group consisted of oxygen atom, nitrogen atom, sulfur atom and phosphorous atom.

DETAILED DESCRIPTION OF THE PREFERRED EMBODIMENTS

Figure 1:
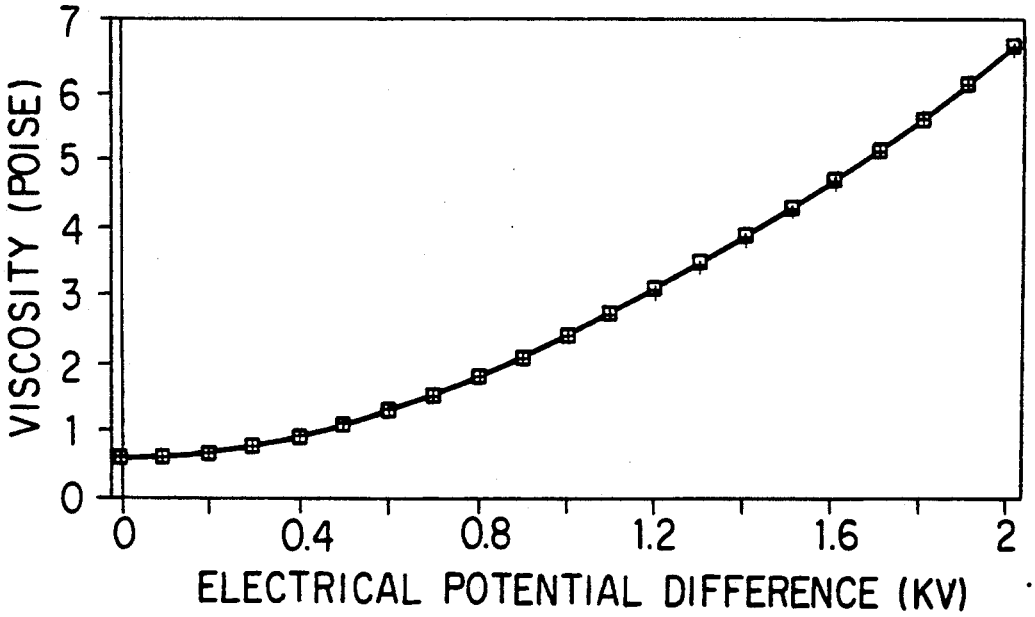
FIG. 1 is a graph indicating the relationship between the electrical potential difference applied to an electrorheological fluid containing (invention; +mark) or without (conventional; □ mark) an ethyleneoxide-modified silicone and the change in viscosity induced thereby.

A nonaqueous type electrorheological fluid according to the present invention comprises organic or inorganic particulates containing not more than 1 wt.% of water and dispersed in an oily medium superior in electrical insulation, wherein the improvement is that said fluid comprises from 0.001 wt.% to 10 wt.% of a compound having a functional group containing at least one atom selected from the group consisted of oxygen atom, nitrogen atom, sulfur atom and phosphorous atom. The present invention will be explained in detail hereinafter.

Nonaqueous type electrorheological fluids which can be the object of the application of the present invention comprises organic or inorganic particulates containing not more than 1 wt.% of water and dispersed in an oily medium superior in electrical insulation. The fluids need no addition of water for the purpose of attaining the electrorheological effect.

As for the electrical insulating oily medium, silicone oils, mineral oils, transformer oils, paraffin oils, halogenated aromatic oils, etc, are used, and the present invention can bring about the effect by any insulating oily medium without no restriction on the kind. Among the electrical insulating oily medium, silicone oils including polydimethylsiloxane and polymethylphenylsiloxane are preferred because it can be used under situations directly in contact with materials having rubber elasticity.

The electrical insulating oily medium is desired to have a viscosity at 25° C. of 0.65–1000 centistokes (cSt), preferably of 5–50 cSt. An oily medium of too low viscosity contains too much volatile components and causes instability of the liquid phase. An oily medium of too high viscosity causes a heightened initial viscosity under no application of electrical potential difference, which makes viscosity changes due to electrorheological effect small. When an electrical insulating oily medium having an appropriately low viscosity is employed, dispersoid is dispersed therein efficiently.

As for the organic or inorganic particulates used as the dispersoid have no restriction on the kind, particle size and composition so far as being able to achieve the electrorheological effect under the water content of less than 1 wt.%, preferably less than 0.5 wt.%.

Exemplified concretely for them are particulates of non-oxide ceramics (e.g. SiC, TiC, $B_4C$), particulates of modified non-oxide ceramics (e.g. solid solution of B in SiC) and carbonaceous particulates.

As to carbonaceous particulates suitable for the dispersoid of nonaqueous type electrorheological fluids to be used in the present invention, the carbon content is preferably 80–97 wt.%, more preferably 90–95 wt.%, and atomic ratio of carbon to hydrogen (C/H ratio) is preferably 1.2–5, more preferably 2–4.

The carbonaceous particulates having the above C/H ratio are exemplified concretely by finely pulverized coal-tar pitch, petroleum pitch and pitch from thermal decomposition of polyvinyl chloride; particulates composed of various mesophases obtained by heat-treatment of these pitch or tar components like particulates obtained from optically anisotropic spherelets (sperulite or mesophase spherelet) by removing pitch components with dissolution in solvents; further pulverized products of these particulates; pulverized bulk mesophase obtained by heat treatment of raw material pitch (Japanese Patent Provisional Publication Tokkai Sho 59-30887 [1984]); pulverized partly crystallized pitch; particulates of so-called low temperature treated carbon like low temperature carbonized thermosetting resins including phenolic resins. Examples are further mentioned of pulverized coal including anthracite and bituminous coal or their heat-treated products; carbonaceous spherelets obtained by heat-treating under pressure mixtures of vinyl-type hydrocarbon polymers like polyethylene, polypropylene or polystyrene and chlorine-containing polymers like polyvinylchloride or ployvinylidenechloride; carbonaceous spherelets obtained by pulverization thereof.

Ratios of the dispersoid to liquid phase constituting electrorheological fluids of the present invention are 1-60 wt.%, preferably 10-50 wt.% of the dispersoid content, and 99-40 wt.%, preferably 90-50 wt.% of the content of liquid phase composed of the electrical insulating oily medium mentioned above. When the dispersoid content is less than 1 wt.%, the electrorheological effect is small, and the initial viscosity under no application of electrical potential difference becomes extremely large when the content is greater than 60 wt.%.

Average particle size desirable as the dispersoid is 0.01-100 microns, preferably 0.1-20 microns, and more preferably 0.5-5, microns. When it is smaller than 0.01 micron, the initial viscosity under no application of electrical potential difference becomes too large to cause small viscosity change by the electrorheological effect, and particle size larger than 100 microns causes insufficient stability of the dispersoid in liquid phase.

In the present invention, a compound having a functional group containing at least one atom selected from the group comprising oxygen atom, nitrogen atom, sulfur atom and phosphorous atom is incorporated in the electrorheological fluid which comprises organic or inorganic particulates containing not more than 1 wt.% of water and dispersed in an oily medium superior in electrical insulation.

As examples of the compound having a functional group containing at least one atom selected from the group comprising oxygen atom, nitrogen atom and sulfur atom, such compounds as those having ether bond; carbonyl group contained in ketones, aldehydes, esters, acid anhydrides, acid halides and amides; hydroxyl group; amino group or sulfonic group are mentioned. Especially recommended are compounds having molecules composed partly or entirely of hydrophilic functional groups, which are characterized by the surface activity expressed in HLB (Hydrophilic-Lipophilic Balance) value of above 0.003, preferably above 0.03, more preferably above 0.2 and below 20.

Concrete examples of the compound are polyethers like ethyleneglycol, triethyleneglycol and polyethyleneglycol; silicones modified by ethyleneoxide, propyleneoxide and the like; fatty acids like lauric acid and parmitic acid; esters of these fatty acids with alcohols; alcohols like methanol, ethanol, lauryl alcohol and oleyl alcohol; nitrogen-containing compounds like pyridine; oil-soluble sulfonates like petroleum sulfonates and calcium dodecylbenzenesulfonate; and polymers like liquid polymethacrylate.

Though the compounds having ionic hydrophilic groups such as oil-soluble sulfonates like petroleum sulfonates and calcium dodecylbenzenesulfonate are effective for suppressing the increase in initial viscosity, however, nonionic compounds are preferred due to their smaller influence on the electric current in the electrorheological fluid under application of high electrical potential difference. Notwithstanding the above, ionic compounds may be included in the compound so far as no increase in the electric current flow is noticed.

Additives selected from one or more than two kinds of these compounds are incorporated in amount of from 0.001 to 10 wt.%, preferably from 0.01 to 2 wt.% into the nonaqueous type electrorheological fluid.

As to the amount of the compound to be added, that of more than 10 wt.% is not preferred, because electric current under application of a high electrical potential difference increases, even though it enables suppression of the increase of initial viscosity. The amount is preferred to be the minimum amount necessary for suppression of the increase of initial viscosity. From the reason, the upper limit is set at 10 wt.%, and more preferably, less than 2 wt.% is desirable from the viewpoint of a small influence on the current flow.

Methods for adding the compound are not restricted specifically, and may be either one or several kinds of these additives are added beforehand to an insulating oily medium or after preparation of an electrorheological fluid. In order to attain the effects of the present invention, mere addition of the above mentioned compound in an amount mentioned above to a nonaqueous type electrorheological fluid is enough for the purpose, and the fluid can suppress the increase in initial viscosity caused by the extracted component when the fluid is used under contact with rubber, resins or other plastics.

In the electrorheological fluids, such additives as surfactants and dispersing agents may be added so far as the meritorious effects are not deteriorated.

Embodiments and effects of the addition of the above mentioned compounds will be explained concretely hereinafter with Examples, however, the present invention never be limited by the Examples.

EXAMPLE 1

By heat-treating mesophase carbon from coal-tar pitch under nitrogen gas stream, carbonaceous particulates having an average particle size of 3 microns, carbon content of 93.78 wt.%, C/H ratio of 2.35, oxygen atom content of 0.8 wt.% and water content of 0.2 wt.% were obtained. Into 190 grams of a silicone oil (produce of Toshiba Silicone Co,; TSF451.10) were dispersed 100 grams of the carbonaceous particulates to prepare an electrorheological fluid. Into 100 grams of the fluid was added 0.7 gram of an ethyleneoxidemodified silicone (produce of Nippon-Unicar Co.; Silicone Surfactant FZ2171: HLB=2) as a compound having a functional group containing oxygen atom to obtain an electrorheological fluid of the present invention.

Measurements of electrorheological effect for the samples prepared in Examples were conducted with a double cylinder type rotary viscometer, in which changes in viscosities were measured under application of 0–2 KV/mm electrical potential difference between the inner and outer cylinders.

FIG. 1 is a graph indicating the relationship between the electrical potential difference applied to an electrorheological fluid containing (invention; +mark) or without (conventional; □ mark) the ethyleneoxide-modified silicone and the change in viscosity induced thereby. In FIG. 1, the abscissa indicates the applied electrical potential difference (KV) and the ordinate indicates the viscosity (P: poise) of electrorheological fluid.

As is clear from FIG. 1, the addition of the ethyleneoxide-modified silicone does not affect the electrorheological effects as indicated by the utter duplication of □ mark and +mark. Further, the electric current under application of 2KV electrical potential difference for the fluid containing the ethyleneoxide-modified silicone is 0.5 mA, which is the same with that of the non-addition fluid.

A rubber having the composition as shown in Table 2 was immersed into the same weight of the electrorheological fluid containing the ethyleneoxide-modified silicone, and extraction was conducted at 100° C. for 3 days. The measurement of initial viscosity of the electrorheological fluid conducted before and after the extraction showed little change as mentioned in Table 1.

COMPARATIVE EXAMPLE 1

A rubber having the composition as shown in Table 2 was immersed into the same weight of the electrorheological fluid without the ethyleneoxide modified silicone, and extraction was conducted at 100° C. for 3 days. The initial viscosity of the electrorheological fluid changed from 0.8 poise before the extraction to 3.0 poise after the extraction as shown in Table 1.

From Example 1 and Comparative Example 1, it is clear that the effect of adding a compound having a functional group containing oxygen atom is evident.

EXAMPLE 2

An electrorheological fluid was prepared in the same manner as that of Example 1 with the exception of adding 0.8 wt.% per fluid of a mixture in 5:3 weight ratio of the ethyleneoxide-modified silicone having a value of HLB 2 used in Example 1 and tetraethyleneglycol.

Similarly to Example 1, a rubber having the composition as shown in Table 2 was immersed into the same weight of the electrorheological fluid, and extraction was conducted at 100° C. for 3 days. The measurement of initial viscosity of the electrorheological fluid conducted before and after the extraction showed little change as mentioned in Table 1, and the fluid exhibited far small change in the initial viscosity between before and after the rubber extraction in comparison with the non-addition fluid of Comparative Example 1.

EXAMPLE 3

An electrorheological fluid was prepared in the same manner as that of Example 1 with the exception of adding 0.5 wt.% per fluid of a liquid polymethacrylate surfactant (produce of Sanyo Kasei Co; Aquloop 806) as a compound having a functional group containing oxygen atom. The electrorheological effect was measured in the same way as Example 1 for the fluid before and after the rubber extraction, and noticed little change in the initial viscosity between before and after the rubber extraction as mentioned in Table 1.

REFERENCE EXAMPLE

A water-carrying electrorheological fluid was prepared by dispersing into 90 grams of a silicone oil (produce of Toshiba Silicone Co.; TSF451-10) 40 grams of crystallized 3A-type zeolite particulates having an average particle size of 1 μm (produce of Union Showa Co.; water content 4.4 wt.%).

A rubber having the composition as shown in Table 2 was immersed into the same weight of the electrorheological fluid, and extraction was conducted at 100° C. for 3 days. The measurement of initial viscosity conducted before and after the extraction showed little change between before and after the rubber extraction as mentioned in Table 1, and the electrorheological effects was not affected.

From the Reference Example, it is noticed that an water-carrying electrorheological fluid needs no addition of the compound specified in the present invention.

EXAMPLE 4

An electrorheological fluid was prepared in the same manner as that of Example 1 with the exception of adding 0.5 wt.% per fluid of an alcohol-modified silicone (produce of Shinetsu Chemical Co ;X 22-170B) as a compound having a functional group containing oxygen atom. The electrorheological effects were measured in the same way as Example 1 for the fluid before and after the rubber extraction, and noticed little change in the initial viscosity between before and after the rubber extraction as mentioned in Table 1.

EXAMPLE 5

An electrorheological fluid was prepared in the same manner as that of Example 1 with the exception of adding 0.5 wt.% per fluid of an amine-modified silicone (produce of Shinetsu Chemical Co.;KF857) as a compound having a functional group containing nitrogen atom. The electrorheological effects were measured in the same way as Example 1 for the fluid before and after the rubber extraction, and noticed little change in the initial viscosity between before and after the rubber extraction as mentioned in Table 1.

TABLE 1

| | Additive | wt. % of additive | Viscosity (poise) before extraction of rubber | Viscosity (poise) after extraction of rubber |
|---|---|---|---|---|
| Example 1 | Ethylene-oxide-modified silicone | 0.7 | 0.4 | 0.4 |
| Example 2 | Ethylene-oxide-modified silicone + tetraethylene-glycol | 0.8 | 0.6 | 0.8 |
| Example 3 | liquid poly-methacrylate surfactant | 0.5 | 1.2 | 1.3 |
| Example 4 | Alcohol-modified silicone | 0.5 | 0.5 | 0.8 |
| Example 5 | Amine-modified silicone | 0.5 | 0.4 | 0.8 |
| Example 6 | Mercapto-modified silicone | 0.5 | 0.4 | 0.6 |
| Comparative | none | 0 | 0.6 | 3.0 |

TABLE 1-continued

| | Additive | wt. % of additive | Viscosity (poise) before extraction of rubber | Viscosity (poise) after extraction of rubber |
|---|---|---|---|---|
| Example 1 | | | | |
| Reference Example | none | 0 | 0.6 | 0.6 |

EXAMPLE 6

An electrorheological fluid was prepareol in the same manner as that of Example 1 with the exception of adding 0.5 wt.% per fluid of a mercapto-modified silicone (produce of Shinetsu Chemical Co.;X-22-980) as a compound having a functional group containing sulfur atom. The electrorheological effects were measured in the same way as Example 1 for the fluid before and after the rubber extraction, and noticed little change in the initial viscosity between before and after the rubber extraction as mentioned in Table 1.

TABLE 2

| Component | Weight parts |
|---|---|
| Natural rubber | 100 |
| Carbon black (HAF) | 5 |
| Stearic Acid | 2 |
| ZnO | 5 |
| Antioxidant 810NA | 1 |
| Wax | 1 |
| Plasticizer (DOA) | 3 |
| Vulcanization accelerator (CZ) | 1.2 |
| Sulfur | 1.5 |

(Cured at 145° C. for 20 minutes)

When the compound having a functional group containing at least one atom selected from a group consisted of oxygen atom, nitrogen atom, sulfur atom and phosphorous atom is not a hydrophilic one, addition of such compound can improve the electrorheological effect. For example, a non-hydrophilic compound having ether bond(s) such as ethyleneoxide-propyleneoxide-modified silicone can improve the electrorheological effect, though the effect of suppressing the increase of initial viscosity by extraction of rubbers is small.

Examples of a compound having a functional group containing at least one phosphorous atom to be incorporated in the electrorheological fluid which comprises organic or inorganic particulates containing not more than 1 wt.% of water and dispersed in an oily medium superior in electrical insulation are compounds having P═N bonds.

The compound is a group called generally as phosphazene, and the following three kinds of structures are known:

(a) A group of ring-structured compounds having more than 3 units of P═N bond in the molecule;
(b) A group of chain compounds having continuous and repeated P═N bonds in the molecule; and
(c) A group of compounds structured in three dimensional network by P═N bonds.

Compounds belonging to group (a) exemplified are; trimer, tetramer and n-pieces polymer having F atoms like $(PNF_2)_3$, $(PNF_2)_4$ and $(PNF_2)n$ wherein $n<14$; trimer, tetramer and n-pieces polymer having Cl atoms like $(PNCl_2)_3$, $(PNCl_2)_4$ and $(PNCl_2)_n$ wherein $n<14$; trimer, tetramer and n-pieces polymer having Br atoms like $(PNBr_2)_3$, $(PNBr_2)_4$ and $(PNBr_2)_n$ wherein $n<14$; trimer, tetramer and n-pieces polymer having I atoms like $(PNI_2)_3$, $(PNI_2)_4$ and $(PNI_2)_n$ wherein $n<14$; or compounds having partly or entirely substituted organic groups for halogen atoms of the compounds mentioned above.

Such organic group substituted compounds can be obtained by substituting halogen atoms in the trimer, tetramer and n-pieces polymer compounds with nucleophilic reagents like $CF_3CH_2ONa$ and $C_6H_5ONa$. Notwithstanding any synthetic method employed, similar effect of the compound is attainable so far as the compound has more than 3 units of P═N bonds in the molecule and has ring structure.

From a viewpoint of the durability, etc., the cyclic compounds preferred are those having substituted groups of halogen-containing aliphatic alkoxy groups like $CF_3CH_2O$- and $CF_3CF_2CH_2O$-; phenoxy groups like $C_6H_5O$- and $RC_6H_4$- (R: aliphatic hydrocarbon, halogen, aromatic hydrocarbon); halogen-containing aliphatic amino groups like $CF_3CH_2NH$- and $CF_3CF_2CH_2NH$- : and aromatic amino groups like $C_6H_5NH$- and $RC_6H_4NH$- (R: aliphatic hydrocarbon, halogen, aromatic hydrocarbon).

Compounds belonging to group (b) exemplified are; high molecular weight chain compounds having P═N backbone structure and halogen atoms in side chain like $(PNF_2)_n$ wherein $n>13$, $(PNCl_2)_n$ wherein $n>13$, $(PNBr_2)_n$ wherein $n>13$ and $(PNI_2)_n$ wherein $n>13$; or compounds having partly or entirely substituted organic groups for halogen atoms of the compounds having P═N backbone structure mentioned above.

Such organic group substituted high molecular weight chain compounds can be obtained by substituting halogen atoms in the halogen-containing compounds with nucleophilic reagents like $CF_3CH_2ONa$ and $C_6H_5ONa$. Notwithstanding any synthetic method employed, similar effect of the compound is attainable so far as the compound has a backbone structure of P═N bonds in the molecule.

From a viewpoint of the durability, etc., the high molecular weight chain compounds preferred are those having substituted groups of halogen containing aliphatic alkoxy groups like $CF_3CH_2O$- and $CF_3CF_2CH_2O$-; phenoxy groups like $C_6H_5O$- and $RC_6H_4$- (R: aliphatic hydrocarbon, halogen, aromatic hydrocarbon); halogen-containing aliphatic amino groups like $CF_3CH_2NH$- and $CF_3CF_2CH_2NH$- : and aromatic amino groups like $C_6H_5NH$- and $RC_6H_4NH$- (R: aliphatic hydrocarbon, halogen, aromatic hydrocarbon).

Compounds belonging to group (c) are solid generally insoluble in various solvents being obtainable during synthesis of P═N containing compounds belonging to (a) or (b) or nitrogenated phosphorous compounds. They are mainly composed of P atoms and N atoms, and the remainder is a portion of elements included in the raw materials for the synthesis, though depending on their synthetic processes.

For preparation of the electrorheological fluid, a liquid or a solid compound selected from the groups (a), (b) and (c) is incorporated in the fluid in an amount of from 0.001 wt.% to 10 wt %, preferably of from 0.01 wt.% to 10 wt.%, and of more preferably from 0.03 wt.% to 10 wt.%. As to incorporating methods of the compound, there may be various ways like adding to electrorheological fluids at a time during their preparation, at a time after their preparation and in a state of particulates microcapsulated with a phosphazene derivative. Since meritorious effect of the present invention are attainable under employing any of the incorporating method, those ones mentioned in the Examples are never to be restrictive to the present invention.

In the electrorheological fluids, such additives as surfactants and dispersing agents may be added so far as the meritorious effects are not deteriorated.

Embodiments and effects of the addition of the above mentioned compounds will be explained concretely hereinafter with Examples, however, the present invention never be limited by the Examples.

EXAMPLE 7

Carbonaceous particulates having an average particle size of 3 microns, carbon content of 93.78 wt.%, C/H ratio of 2.35 and water content of 0.2 wt.% were obtained by heat-treating mesophase carbon from coal-tar pitch under nitrogen gas stream. 100 grams of the carbonaceous particulates were dispersed into 190 grams of a silicone oil (produce of Toshiba Silicone Co,; TSF451-10). To the dispersion was added 0.35 gram of $(PN(C_6H_5)_2)_3$, and they were mixed in a mortar to prepare an electrorheological fluid.

EXAMPLE 8

An electrorheological fluid was prepared in the same manner as that of Example 7 with the exception that 3.32 grams of the additive $(PN(OC_6H_5)_2)_3$ was added to 100 grams of the dispersion of carbonaceous particulates in the silicone oil.

EXAMPLE 9

An electrorheological fluid was prepared in the same manner as that of Example 7 with the exception that 0.6 gram of the additive $(PN(OCH_2CF_3)_2)_3$ was added to 100 grams of the dispersion of carbonaceous particulates in the silicone oil.

COMPARATIVE EXAMPLE 2

The electrorheological fluid for comparison was the dispersion without addition of $(PN((C_6H_5)_2)_3$ in Example 7.

Measurements of electrorheological effects for the samples prepared in Examples 7–9 and Comparative Example 2 were conducted with a double cylinder type rotary viscometer, in which changes in viscosities were measured under application of 0–2 KV/mm electrical potential difference between the inner and outer cylinders.

As shown in Table 3, a remarkable increase in viscosity under the application of electrical potential difference for samples with small added amounts of phosphazene derivatives indicate clearly the effectiveness of the phosphazene derivatives added.

TABLE 3

| | Additive | wt. % of additive | Viscosity (poise) V = 0 KV | Viscosity (poise) V = 2 KV |
|---|---|---|---|---|
| Example 7 | $(PN(OC_6H_5)_2)_3$ | 0.32 | 0.6 | 8.5 |
| Example 8 | $(PN(OC_6H_5)_2)_3$ | 3.32 | 0.6 | 9.7 |
| Example 9 | $(PN(OCH_2CF_3)_2)_3$ | 2.56 | 0.6 | 9.1 |
| Comparative Example 2 | none | 0 | 0.6 | 6.5 |

EXAMPLE 10

By heat-treating mesophase carbon from coal-tar pitch under nitrogen gas stream, carbonaceous particulates having an average particle size of 3 microns, carbon content of 93.78 wt.%, C/H ratio of 2.35, oxygen atom content of 0.8 wt.% and water content of 0.2 wt.% were obtained. Into 19 grams of a silicone oil (produce of Toshiba Silicone Co,; TSF451-10) were dispersed 10 grams of the carbonaceous particulates to prepare a base electrorheological fluid. As a compound having ether bond(s), 0.5 wt.% of an ethyleneoxide-propyleneoxide-modified silicone (produce of Nippon-Unicar Co.; Silicone surfactant L-720) was added into the fluid to obtain an electrorheological fluid of the present invention.

EXAMPLE 11

As a compound having ether bond(s), 0.5 wt.% of a copolymer of ethyleneoxide and propyleneoxide (produce of Sanyo Kasei Co; Unipol) was added into the base fluid prepared in Example 10 to obtain an electrorheological fluid of the present invention.

Viscosities of the electrorheological fluids of Example 10 and Example 11 under application of no electrical potential difference, under application of 2 KV/mm electrical potential difference and difference between them are shown in Table 4. The greater the viscosity difference, more excellent is the electrorheological effect. Values of electric current under application of 2 KV/mm electrical potential difference are also shown in Table 4.

The electrorheological fluids of Example 10 and Example 11 added with a compound having ether bond(s) showed improved electrorheological effects compared with the electrorheological fluid of Comparative Example 3 added with no compound having ether bond(s) as can be noticed in Table 3. On the other hand, values of electric current under application of 2 KV/mm electrical potential difference in Example 10 and Example 11 were almost the same as that of Comparative Example 3.

TABLE 4

| | Additive | wt. % | Viscosity (poise) at 0 KV | Viscosity (poise) at 2 KV | Viscosity (poise) diff. | Electric current at 2 KV (mA) |
|---|---|---|---|---|---|---|
| Example 10 | Ethylene-oxide · propylene-oxide-modified silicone | 0.5 | 1.118 | 6.182 | 5.064 | 0.38 |
| Example 11 | Copolymer of ethyleneoxide & propyleneoxide | 0.5 | 2.60 | 10.05 | 7.54 | 0.38 |
| Comp. Example 3 | none | 0 | 0.561 | 4.773 | 4.212 | 0.35 |

We claim:

1. An electrorheological fluid which comprises 1–60 wt. % of carbonaceous particulates containing not more than 1 wt. % of water and dispersed in 99–40 wt. % of an oily medium superior in electrical insulation selected from the group consisting of silicone oils, mineral oils, transformer oils, paraffin oils and halogenated aromatic oils, wherein said improvement is said carbonaceous particulates are those having a carbon content of 80–97 wt.%, C/H ratio (atomic ratio of carbon/hydrogen) of 1.2–5 and oxygen atom content of not more than 10 wt.% and that said fluid contains from 0.001 wt.% to 10 wt% of a compound having an ether bond, P=N bonds, carbonyl group, hydroxyl group, amino group or sulfonic group.

2. An electrorheological fluid according to claim 1, in which said compound is a silicone respectively modified with alkyleneoxide, alcohol, amine or mercaptan; an alkyleneoxide polymer; a liquid acrylester polymer; or a phosphazene having 3 units of P=N bond in the molecule.

* * * * *